US009903329B2

(12) United States Patent
Peters et al.

(10) Patent No.: US 9,903,329 B2
(45) Date of Patent: Feb. 27, 2018

(54) FUEL INJECTOR

(75) Inventors: Lester L. Peters, Columbus, IN (US); Jeffrey C. Huang, Greenwood, IN (US); David L. Buchanan, Westport, IN (US); Corydon Edward Morris, Columbus, IN (US); Gary Gant, Columbus, IN (US); Denis Gill, St. Josef (AT); Heribert Kammerstetter, Oberalm (AT); Ernst Winklhofer, St. Johann ob Hohenburg (AT)

(73) Assignee: CUMMINS INTELLECTUAL PROPERTY, INC., Minneapolis, MN (US)

( * ) Notice: Subject to any disclaimer, the term of this patent is extended or adjusted under 35 U.S.C. 154(b) by 1223 days.

(21) Appl. No.: 13/448,098

(22) Filed: Apr. 16, 2012

(65) Prior Publication Data

US 2013/0270369 A1 Oct. 17, 2013

(51) Int. Cl.

| | |
|---|---|
| ***F02M 59/00*** | (2006.01) |
| ***F02M 61/10*** | (2006.01) |
| ***F02M 61/18*** | (2006.01) |

(52) U.S. Cl.

CPC ..... *F02M 61/10* (2013.01); *F02M 61/1866* (2013.01)

(58) Field of Classification Search

CPC ..... F02M 61/10; F02M 61/1866

USPC ..... 239/533.12, 533.2, 533.3, 533.4, 584

See application file for complete search history.

(56) References Cited

U.S. PATENT DOCUMENTS

| | | | | |
|---|---|---|---|---|
| 3,836,080 | A * | 9/1974 | Butterfield | F02M 61/18 239/533.4 |
| 4,153,205 | A * | 5/1979 | Parrish, Jr. | F02M 61/10 239/533.12 |
| 4,292,947 | A | 10/1981 | Tanasawa et al. | |
| 4,417,694 | A | 11/1983 | Claxton et al. | |
| 4,934,605 | A | 6/1990 | Hans et al. | |
| 4,945,877 | A | 8/1990 | Ziegler et al. | |
| 5,743,238 | A | 4/1998 | Shorey et al. | |
| 5,743,470 | A | 4/1998 | Schlaf et al. | |
| 6,173,912 | B1 | 1/2001 | Gottlieb et al. | |
| 6,186,419 | B1 | 2/2001 | Kampmann et al. | |
| 6,427,932 | B1 | 8/2002 | Danckert et al. | |
| 6,752,131 | B2 | 6/2004 | Poola et al. | |
| 6,789,406 | B2 | 9/2004 | Spencer | |
| 6,811,105 | B2 * | 11/2004 | Kato | F02M 45/08 239/533.2 |
| 7,000,856 | B2 | 2/2006 | Mattes et al. | |

(Continued)

FOREIGN PATENT DOCUMENTS

DE PCT/EP2010063640 * 3/2011 ..... F02M 61/18

OTHER PUBLICATIONS

T.-C. Hsieh et al.; "Application of Computational Fluid Dynamics for Flow Force Optimization of a High Pressure Fuel Injector Spill Valve"; SAE International; International Spring Fuels & Lubricants Meeting & Exposition; Dearborn, MI; May 3-6, 1999.

(Continued)

*Primary Examiner* — Arthur O Hall
*Assistant Examiner* — Joel Zhou
(74) *Attorney, Agent, or Firm* — Faegre Baker Daniels LLP

(57) ABSTRACT

A fuel injector is provided that includes various precise configuration parameters, including dimensions, shape and/or relative positioning of fuel injector features, resulting in improved efficiency of fuel flow through the fuel injector.

15 Claims, 6 Drawing Sheets

(56) References Cited

U.S. PATENT DOCUMENTS

| | | | | |
|---|---|---|---|---|
| 7,055,548 | B2 | 6/2006 | Hamblin et al. | |
| 7,108,244 | B2 | 9/2006 | Hardin | |
| 9,297,344 | B2 * | 3/2016 | Gerber | F02M 61/1866 |
| 2008/0022975 | A1 | 1/2008 | Petrone et al. | |
| 2013/0270369 | A1 * | 10/2013 | Peters | F02M 61/10 239/533.2 |

OTHER PUBLICATIONS

M. Gavaises et al., "Link Between Cavitation Development and Erosion Damage in Diesel Injector Nozzles"; SAE International; 2007 World Congress; Detroit, MI, Apr. 16-19, 2007.

A. Mulemane; "Modeling Dynamic Behavior of Diesel Fuel Injection Systems"; SAE International; 2004 SAE World Congress; Detroit, MI; Mar. 8-11, 2004.

Z. Zhang; "Analysis of impact and motion of the needle in diesel engine injector"; College of Energy and Power Eng., Huazhong Univ. of Sci. and Technol., Wuhan, China; vol. 34, Issue n 3, 2006, pp. 75-78.

M.Li; "Improved design and three-dimensional numerical simulation of nozzle of a locomotive diesel engine"; School of Traffic and Transportation, Dalian Jiaotong University, Dailian, China; vol. 28, Issue n 4, Aug. 2007, 2007; pp. 32-35.

R. Payri; "Using one-dimensional modelling codes to analyse the influence of diesel nozzle geometry on injection rate characteristics"; CMT-Motores Termicos, Univ. Politecnica de Valencia, Valencia, Span; vol. 38, Issue n1, 2005, pp. 58-76.

"Development of cavitation and enhanced injector models for diesel fuel injection system simulation"; Institution of Mechanical Engineers, London, England; Journal of Automobile Engineering vol. 216, No. D7; 2002.

* cited by examiner

FUEL INJECTOR

TECHNICAL FIELD

This disclosure relates to fuel injectors for internal combustion engines, and specifically to a needle or plunger with improved fuel flow efficiency through the seat area.

BACKGROUND

Many internal combustion engines use fuel injectors to direct the flow of fuel into a combustion chamber. To adjust the amount of fuel into a combustion chamber, it is common to design the diameter of the seat to be larger, to design the needle or plunger to lift further from a seat, or to open a fuel injector for a longer period.

Changing the seat diameter creates multiple difficulties. For example, as the seat diameter grows, the outside diameter of the fuel injector needs increased disproportionately because the fuel injector forms a pressure vessel, which means that increasing the outside diameter of the fuel injector also requires an increase in the wall thickness of the fuel injector. The increased wall thickness requires additional diameter of the fuel injector specifically to accommodate the increased wall thickness. An increased nozzle seat diameter may also require an increased plunger diameter to maintain the plunger response. Increasing the size of these components can lead to a reduced speed of operation of the fuel injector. It may not be possible in some engines to modify the diameter of a fuel injector because of space considerations.

Changing the lift distance of the plunger can undesirably affect the response speed of the fuel injector. Increasing the lift distance may also result in increased injector-to-injector fueling variability, which is highly undesirable as fueling consistency is important for engine efficiency.

Opening a fuel injector for a longer period to increase the amount of fuel delivered may cause problems with other aspects of engine operation. For example, extending the length of fuel injection may interfere with combustion and exhaust timing. Therefore, increasing the amount of fuel delivered by increasing the length of time a fuel injector is open may not be possible.

Thus, there is a need to increase fuel flow under circumstances that would limit changing the distance a needle or plunger travels, under circumstances that would limit the size of an injector seat, and under circumstances that would limit the length of time an injector is open.

SUMMARY

This disclosure provides a fuel injector device for injecting fuel into a combustion chamber of an internal combustion engine. The fuel injector device comprises an elongate injector body having a longitudinal axis, an injector cavity including an injector sac, an injector orifice communicating with the injector sac, an inner annular surface including a seat positioned upstream of the injector sac, and a fuel flow surface extending between the injector sac and the seat, and a fuel supply circuit adapted to supply fuel for injection through the injector orifice. A nozzle valve element is positioned within the injector cavity. The nozzle valve element is adapted to move along the longitudinal axis between a maximum open nozzle position, in which fuel flows from the fuel supply circuit through the injector orifice into the combustion chamber, and a closed nozzle position wherein a first end of the nozzle valve element contacts the seat and fuel flow through the injector orifice is blocked. The first end of the nozzle valve element includes a tip, a contact surface positioned to contact the seat when the nozzle valve element is in the closed nozzle position, and a first flow-guiding surface extending from the contact surface toward the tip and opposing the fuel flow surface. The first flow-guiding surface is free of discontinuities and is spaced away from the fuel flow surface when the nozzle valve element is in the closed nozzle position. The first flow-guiding surface forms an angle of at least 2 degrees with the fuel flow surface. When the nozzle valve element is in the maximum open nozzle position, the contact surface is positioned a spaced distance from the seat to form a gap having a maximum lift cross-sectional flow area Amax defined by a first conical frustum extending across a shortest distance between the seat and the contact surface. An annular cross-sectional flow area Agap, defined by a second conical frustum extending perpendicular to the fuel flow surface from the fuel flow surface to the first flow-guiding surface at every point along the fuel flow surface opposing the first flow-guiding surface satisfies the inequality $(0.95)(Amax) \leq Agap \leq (1.30)(Amax)$ at every point along the fuel flow surface opposing the first flow-guiding surface when the nozzle valve element is in the maximum open nozzle position.

This disclosure also provides a fuel injector device for injecting fuel supplied by a fuel supply circuit into a combustion chamber into a combustion chamber of an internal combustion engine. The fuel injector comprises an elongate injector body having a longitudinal axis, an injector cavity including at least one injector orifice proximate a first end of the injector cavity, an inner annular surface having a seat positioned upstream of the at least one injector orifice, and a fuel flow surface extending from the seat toward the at least one injector orifice, wherein the inner annular surface is at a first angle about the longitudinal axis, a nozzle valve element positioned within the injector cavity, the nozzle valve element adapted to move along the longitudinal axis between a maximum open nozzle position, in which fuel flows from the fuel supply circuit through the injector orifice into the combustion chamber, and a closed nozzle position wherein a first end of the nozzle valve element contacts the seat surface and fuel flow through the injector orifice is blocked. The first end of the nozzle valve element includes a tip, a contact surface positioned to contact the seat when the nozzle valve element is in the closed nozzle position, and a first flow-guiding surface extending from the contact surface toward the tip and opposing the fuel flow surface. The first flow-guiding surface is free of discontinuities and is at a second angle about the longitudinal axis that is greater than the first angle by at least 4 degrees. When the nozzle valve element is in the maximum open nozzle position the contact surface is positioned a spaced distance from the seat to form an annular gap having a maximum lift cross-sectional flow area Amax defined by a conical frustum extending across a shortest distance between the seat and the contact surface. A plurality of frusto-conical flow areas Agap is located between the inner annular surface and the first flow-guiding surface. Each of the flow areas Agap is defined by a frustum centered on the longitudinal axis that extends perpendicular from the inner annular surface at any location where the frustum intersects the first flow-guiding surface. Each of the plurality of flow areas Agap satisfies the inequality $(0.95)(Amax) \leq Agap \leq (1.30)(Amax)$ when the nozzle valve element is in the maximum open nozzle position.

Advantages and features of the embodiments of this disclosure will become more apparent from the following detailed description of exemplary embodiments when viewed in conjunction with the accompanying drawings.

DETAILED DESCRIPTION

Throughout this application, the words "inner," "inward," "inwardly," and "lower" will correspond to the direction toward the point at which fuel from an injector is injected into the combustion chamber of an engine, typically the injector orifices. Similarly, the words "outer," "outward," "outwardly," and "upper" will correspond to the portions of the injector assembly that are farthest from the point at which fuel from an injector is injected into the combustion chamber of an engine, which would typically be injector orifices.

Figure 1:
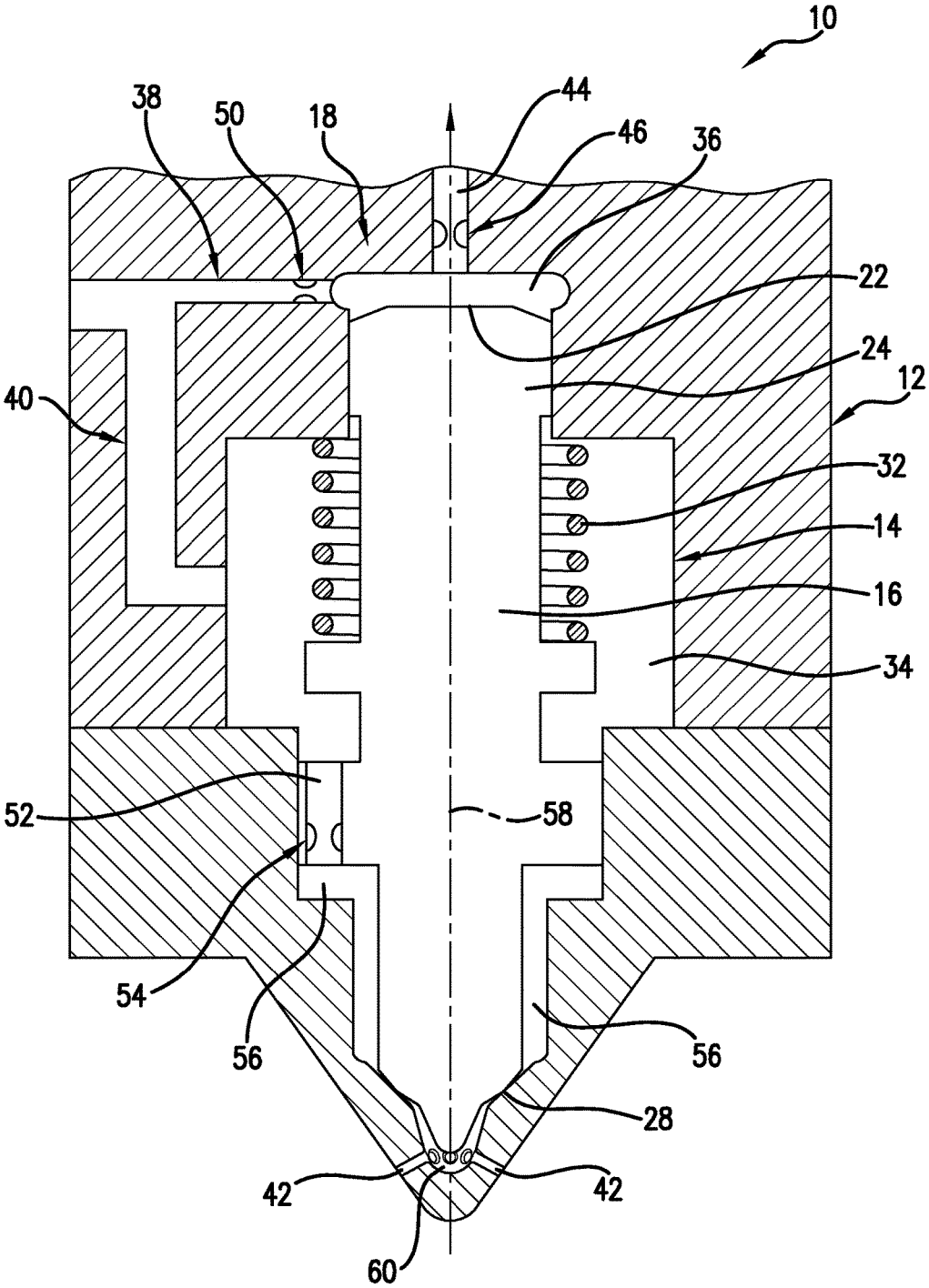
FIG. 1 is a sectional schematic view of a fuel injector of the present disclosure with the nozzle valve element in the closed position.
Figure 2:
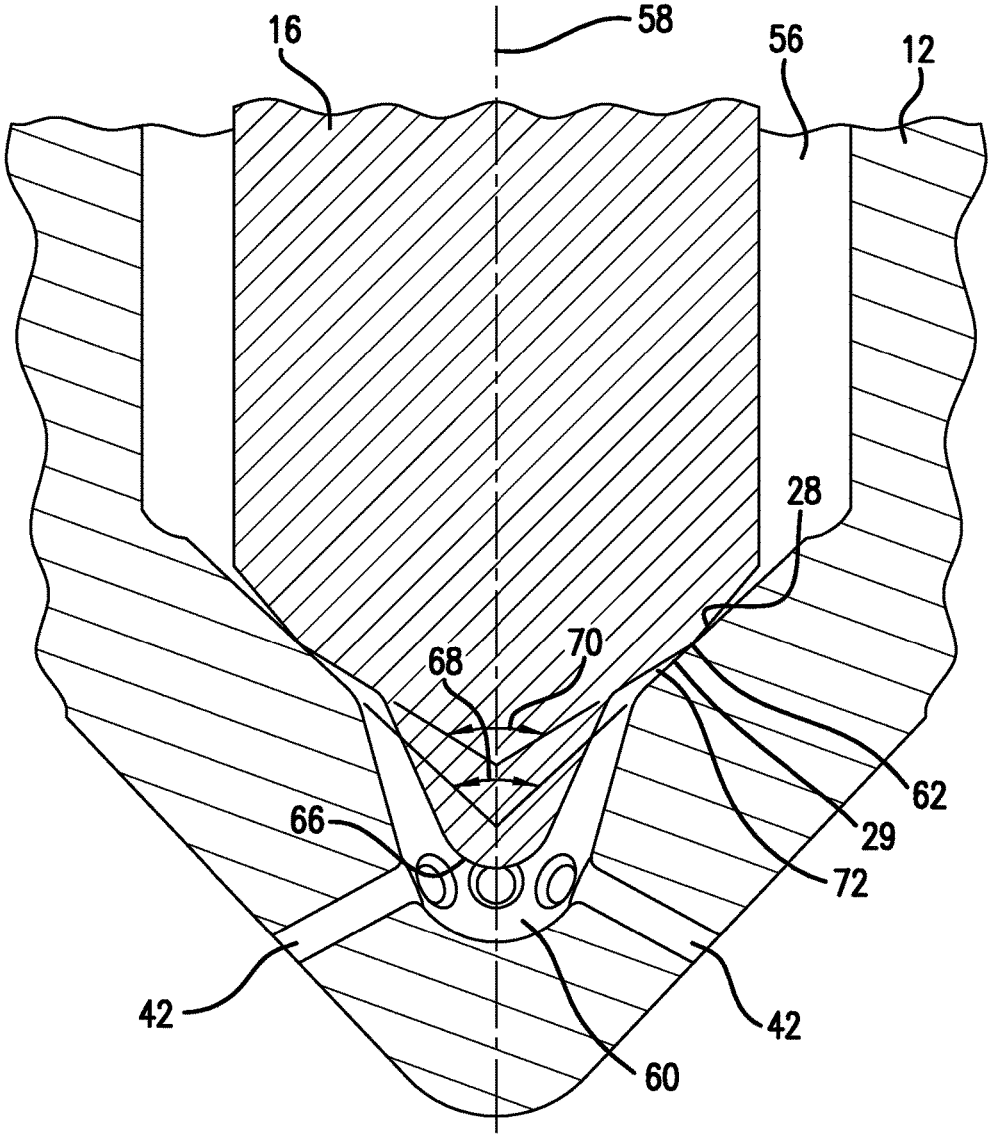
FIG. 2 is a sectional view of the inward end of the fuel injector of FIG. 1 with the nozzle valve element in the closed position.

Referring to FIGS. 1 and 2, there is shown an illustration of a fuel injector 10 in accordance with an exemplary embodiment of the present disclosure. Though the present disclosure describes particular configurations of fuel injectors, the features of the present disclosure may be used on any fuel injector compatible with the features of the present disclosure. For example, the fuel injector may be in the form of the injector disclosed in U.S. Pat. No. 6,499,467, the entire content of which is hereby incorporated by reference. The fuel injector may be in the form of the injector disclosed in U.S. Pat. No. 7,028,918, the entire content of which is hereby incorporated by reference.

Fuel injector 10 includes an elongate injector body 12 containing an injector cavity 14, a needle valve, plunger or nozzle valve element 16 mounted for reciprocal or longitudinal movement in injector cavity 14, and a nozzle valve actuating system 18. Nozzle valve element 16 includes an outer end 22 including a guide portion 24 having an outer peripheral extent sized and positioned to form a close sliding fit with the inside surface of injector cavity 14. Nozzle valve element 16 also includes a contact surface 62 positioned at an inner end for engaging an inner annular valve seat 28 formed on injector body 12 when nozzle valve element 16 is in the closed position shown in FIG. 1. Nozzle valve element 16 may be biased in the closed position by a bias spring 32 that may be located in a spring chamber 34 located within injector cavity 14.

Nozzle valve actuating system 18 may include an outer control volume or cavity 36 formed in injector body 12 and positioned adjacent outer end 22 of nozzle valve element 16. Nozzle valve actuating system 18 may also include a control volume charge circuit 38 for directing fuel from a fuel transfer or fuel supply circuit 40 to outer control volume 36. Fuel supply circuit 40 also delivers fuel to spring chamber 34 for delivery to at least one injector orifice 42 when nozzle valve element 16 is in an open position as discussed more fully hereinbelow. Nozzle valve actuating system 18 also includes a drain circuit 44 for draining fuel from outer control volume 36 when commanded by an injection control valve (not shown) for controlling the flow of fuel through drain circuit 44 so as to cause controlled movement of nozzle valve element 16 between open and closed positions.

When commanded by an actuator assembly (not shown), fuel will flow through outer restriction orifice 50 into outer control volume 36. A drain restriction orifice 46 located in drain circuit 44 has a larger cross-sectional flow area than outer restriction orifice 50. The actuator assembly (not shown) also permits fuel flow out from fuel injector 10 through drain circuit 44. The larger cross-sectional flow area of drain restriction orifice 46 as compared to outer restriction orifice 50 will thus permit fuel to drain from outer control volume 36 than is replenished via control volume charge circuit 38. As a result, the pressure in outer control volume 36 immediately decreases as compared to control volume charge circuit 38 and fuel supply circuit 40. Fuel simultaneously flows into fuel supply circuit 40 and then through a transfer passage 52 past an inner restriction orifice 54 into an inner control volume 56. Because inner restriction orifice 54 has a larger cross-sectional flow area than outer restriction orifice 50, the pressure in inner control volume 56 becomes approximately the same as the pressure in control volume charge circuit 38 and fuel supply circuit 40, which, as has already been described, is higher than the pressure in outer control volume 36. The result of the pressure differential on the two ends of nozzle valve element 16 is that nozzle valve element 16 moves longitudinally or reciprocally along axis 58 of nozzle valve element 16 from the closed position shown in FIGS. 1-3 to the open position shown in FIG. 4.

When nozzle valve element 16 begins to lift, fuel pressure increases in a sac 60 located between injector body 12 and the inner end of nozzle valve element 16, thereby assisting in lifting nozzle valve element 16 at an even greater rate. Simultaneously, fuel begins to flow from sac 60 through at least one injector orifice 42 into the engine combustion chamber (not shown).

When the actuator assembly (not shown) is de-energized or commanded to stop fuel flow, fuel will cease flowing through drain circuit 44 and fuel pressure will begin to build in outer control volume 36. Fuel simultaneously drains from sac 60 via at least one injector orifice 42, decreasing pressure in sac 60 and then in inner control volume 56. The result of the pressure differential between outer control volume 36 and inner control volume 56 is that nozzle valve element 16 will move from the open position to the closed position.

When a particular design requires additional fuel to be delivered, the lift height of a nozzle valve element may be designed to move a further distance to provide a greater opening at the seat. Alternatively, the seat size may be increased during design to provide a larger flow area at a particular lift. Another method of delivering additional fuel is to increase the length of time the nozzle valve element is open. However, moving the fuel injector greater distances along its longitudinal axis leads to problems. For example, the time it takes to move a fuel injector to a position that corresponds to fully open may cause difficulties in shaping the fuel injected into a combustion chamber, leading to incomplete combustion. The increased distance may also require additional time to close the fuel injector, leading to undesirable injection events. In some fuel injectors, the type of mechanism used to open and close the fuel injector, e.g. a piezoelectric actuator, may be incapable of a large range of movement. In such situations, the length of time the nozzle valve element 16 is opened may be increased. However, there are circumstances where increasing the length of injection leads to undesirable combustion events depending on the timing of other activities related to the combustion chamber, such as valves opening and closing and piston movement. The present disclosure provides for an improved fuel injector configuration that has improved efficiency in the injection of fuel, increasing the capability to deliver fuel to a combustion chamber as compared to similarly configured fuel injectors opening at a similar distance, as described hereinbelow. Specifically, the dimensions, shape and/or relative position of fuel injector 10 features improves the efficiency of fuel flow through fuel injector 10 and shortens the time needed to close fuel injector 10.

Figure 3:
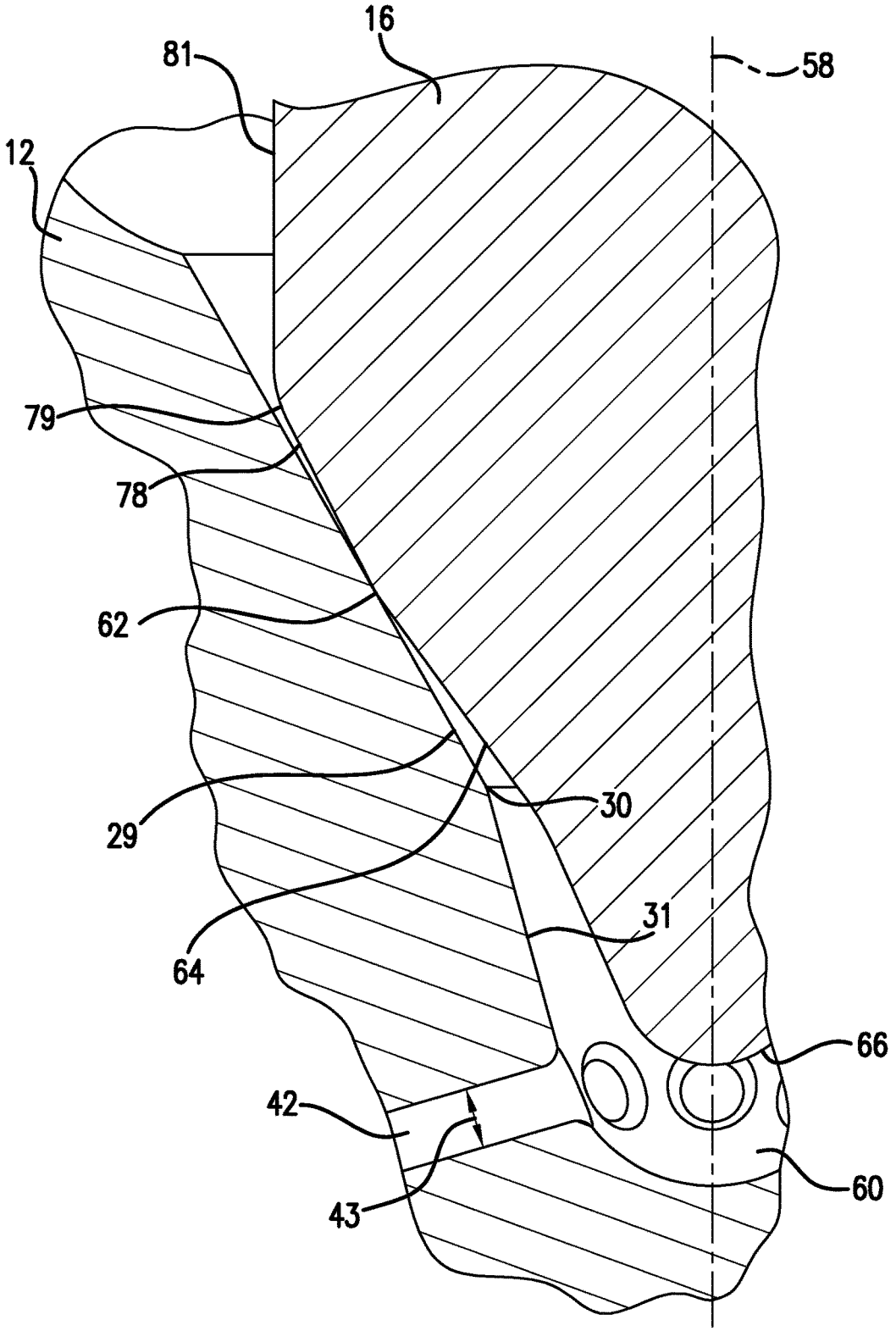
FIG. 3 is a sectional view of a portion of the inward end of the fuel injector of FIG. 1 with the nozzle valve element in the closed position.
Figure 4:
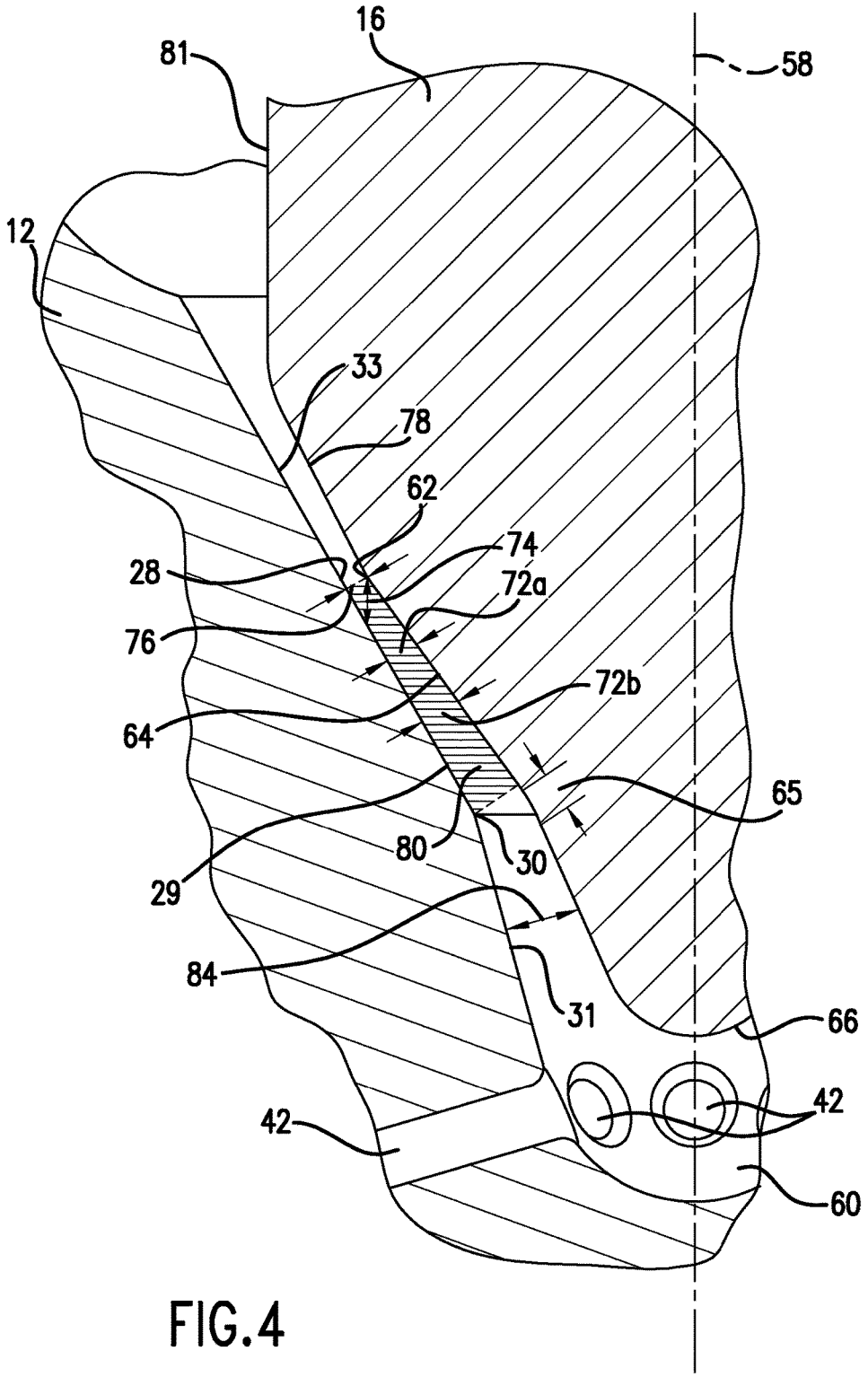
FIG. 4 is a sectional view of a portion of the inward end of the fuel injector of FIG. 1 with the nozzle valve element in the open position.

Referring now to FIGS. 2-4, there is shown a cross-sectional view of a portion of nozzle injector 10. As previously noted, nozzle valve element, needle valve or plunger 16 includes contact portion 62. Adjacent contact surface 62 is a first flow-guiding surface 64 that extends toward tip 66 of nozzle valve element 16. First flow-guiding surface 64 terminates at a first curvature or corner 65, which extends to join with nozzle element tip 66.

First flow-guiding surface 64 is generally feature-free. Generally feature-free means that, other than machining marks or small variations due to manufacturing technique, first flow-guiding surface 64 is generally straight and forms a conical frustum about nozzle valve element 16 that is centered on axis 58. Another way of describing the generally feature-free condition of first flow-guiding surface 64 is that it is free of discontinuities, meaning there are no recesses, protrusions or other features except the machining marks or small manufacturing variations previously noted.

The term conical frustum is used in this disclosure to describe some of the surfaces of this disclosure. A term that describes a conical frustum or the shape of a conical frustum is frusto-conical. Thus, the two terms should be considered as referring to the same shape.

Extending from valve seat 28 toward injector sac 60 or injector orifice 42 is a fuel flow surface 29, which is an extension of valve seat 28 and which may be at the same angle as valve seat 28. Valve seat 28 and fuel flow surface 29 may be in the form of a conical frustum or a frusto-conical surface that is centered on axis 58. Fuel flow surface 29 terminates at a second radius or edge 30. Second radius or edge 30 extends to join with injector orifice surface 31 in which injector orifice 42 is located and which may be part of sac 60.

First flow-guiding surface 64 is formed at a different angle from valve seat 28 and fuel flow surface 29, as shown in FIG. 3. Valve seat 28 and fuel flow surface 29 has a seat angle 68 centered on longitudinal axis 58. First flow-guiding surface 64 is formed at a first flow-guiding surface angle 70 that is greater than seat angle 68. The effect of first flow-guiding surface angle 70 being larger than seat angle 68 is that first flow-guiding surface 64 does not contact fuel flow surface 29 and a resulting gap 72 between fuel flow surface 29 and first flow-guiding surface 64 increases gradually as the distance from contact surface 62 toward tip 66 increases. In the embodiment shown in FIGS. 2-4, angle 68 is about 60 degrees and angle 70 is between 64 and 69 degrees.

As can be seen in FIG. 4, when nozzle valve element 16 is open at its maximum lift distance 74, the shortest distance between contact surface 62 and valve seat 28 is distance 76. The annular cross-sectional area between contact surface 62 and valve seat 28 at distance 76 is a conical frustum or a frusto-conical shape about axis 58 of nozzle valve element 16 and is defined as an ideal cross-sectional flow area Amax. Since first flow-guiding surface 64 angles away from fuel flow surface 29, the distance between two opposing portions of first flow-guiding surface 64 and fuel flow surface 29, for example, an annular gap 72*a* measured along a line perpendicular to valve seat 28 and extending from fuel flow surface 29 to first flow-guiding surface 64, increases with distance from contact surface 62 toward tip 66. Thus, an annular gap 72*b* positioned further downstream from gap 72*a* is larger than annular gap 72*a*. Annular gap 72*a* is part of a first conical frustum or a frusto-conical shape between two opposing portions of first flow-guiding surface 64 and fuel flow surface 29, defined as Agap(1). Annular gap 72*b* is part of a second conical frustum or frusto-conical shape that is also between two opposing portions of first flow-guiding surface 64 and fuel flow surface 29, defined as Agap(2). Since both fuel flow surface 29 and first flow-guiding surface 64 extend a distance in opposition, there are an infinite number of conical frustums or frusto-conical shapes with a cross sectional flow area Agap(n) in a region 80 between fuel flow surface 29 and first flow-guiding surface 64. However, each frustum area Agap(n), i.e., each annular cross-sectional flow area, at any opposing annuli of first flow-guiding surface 64 and fuel flow surface 29 in region 80 in FIG. 4, exemplified by gap 72*a* and gap 72*b*, must satisfy the inequality in equation 1 when nozzle valve element 16 is at its maximum lift distance 74 in order to maximize fuel flow efficiency between first flow-guiding surface 64 and fuel flow surface 29.

$$(0.95)(A\text{max}) \leq A\text{gap}(n) \leq (1.30)(A\text{max}) \qquad \text{Equation 1}$$

Efficiency is at a better optimum if the cross-sectional flow area Agap satisfies the inequality in equation 2.

$$(0.975)(A\text{max}) \leq A\text{gap}(n) \leq (1.15)(A\text{max}) \qquad \text{Equation 2}$$

Note that a second flow-guiding surface 78 extends from contact surface 62 away from tip 66, which is also away from sac 60 and which is also away from injector orifice or orifices 42. Second flow-guiding surface 78 may extend to a third corner, edge or radius 79 that joins with side 81 of nozzle valve element 16. Similarly, a second fuel flow surface 33 extends from valve seat 28 away from injector sac 60. Second flow-guiding surface 78 is preferably at a shallower angle or a smaller angle than the angle of second fuel flow surface 33. Regardless of the angle of second flow-guiding surface 78, the area of any conical frustum extending perpendicularly to second fuel flow surface 33 to intersect second flow-guiding surface 78 must be equal to or great than Amax.

As noted hereinabove, a conical frustum may be constructed at any point along second fuel flow surface 33 perpendicular to second fuel flow surface 33 and extending to second flow-guiding surface 78. Each conical frustum has an area Asec(n). Each area Asec(2) is equal to or greater than any area Asec(1) positioned between the location of area Asec(2) and valve seat 28 It is also preferable that any increase in Asec(n) with distance from valve seat 28 be gradual and without discontinuities to prevent pressure drops forming between second fuel flow surface 33 and second flow-guiding surface 78 and to assist in limiting cavitation that might occur should discontinuities exist.

Note from the foregoing discussion that it is preferable that contact surface 62 be the only location of contact between needle valve element 16 and valve seat 28. It should also be clear from the foregoing discussion that the smallest cross-sectional flow area between nozzle valve element 16 and the inner surface of injector body 12 when nozzle valve element 16 is in an open position is the shortest conical frustum possible between contact surface 62 and valve seat 28. The cross-sectional flow area between nozzle valve element 16 and any downstream point, which includes fuel flow surface 29, radius or edge 30 and injector orifice surface 31, should remain approximately constant or increase slightly throughout the distance from the point at which the shortest distance 76 is measured to a location just above injector orifice 42. For example, a conical frustum extends perpendicularly from injector orifice surface 31 to nozzle valve element tip 66 at location 84. This conical frustum may have an area Atip. An infinite number of such conical frustums may be constructed between injector orifice surface 31 and nozzle valve element tip 66, each having an area Atip(n). As the longitudinal distance to injector orifice 42 decreases, and the longitudinal distance from contact surface 62 increases, the size of area Atip(n) remains as close to constant as possible, which can be seen by comparing the two inequalities noted above and noting that the preferred inequality is the one that provides a narrower range for Agap(n). The narrower range, or a range closer to a constant through all locations where Agap(n) exists, provides a more optimal fuel flow delivery in comparison to a configuration where Agap(n) falls outside the inequalities previously noted. If there is a change in the value of Agap(n) as the longitudinal distance from contact surface 62 toward injector orifice 42 increases, the value of Agap(n) will preferably increase while meeting the previously described inequalities.

In view of the discussion hereinabove, the requirement for Agap(n) and Atip(n) may be stated as follows. Surface 64 and surface 29 define the flow area from contact surface 62 to first curvature 65. Similarly, surface 31 and the surface profile of nozzle cavity element 16 from first curvature 65 along tip 66 defines the flow area further downstream from first curvature 65. When nozzle cavity element 16 is at a full or maximum lift height or condition, the flow area between surface 64 and surface 29 and further downstream between surface 31 and first curvature 65 and between surface 31 and tip 66 needs to be as close to a constant as possible. This condition needs met to a region just upstream of injector orifices 42. The dimensions provided hereinabove for the first exemplary embodiment and the dimensions provided hereinbelow for the second exemplary embodiment are but two of the many configurations possible to meet the design goal of keeping the flow area nearly constant in the gap between injector body 12 and nozzle valve element 16.

Because of the rapidity with which nozzle valve element 16 moves longitudinally, fuel flow begins primarily once nozzle valve element 16 is at its maximum lift position. Fuel travels between contact surface 62 and valve seat 28, and then between first flow-guiding surface 64 and fuel flow surface 29. Fuel then travels between tip 66 and injector orifice surface 31. The approximately constant, or gradually increasing slightly within the aforementioned limits in equation 1 and equation 2, cross-sectional area throughout the fuel flow path provides a constant and smooth fuel flow path with reduced fuel separation from the surfaces that might lead to turbulence and cavitation. The net effect of the improved fuel flow is a significant improvement in fuel flow efficiency and reduced cavitation over conventional fuel injector designs. As noted in more detail below, the improved fuel flow efficiency permits greater fuel to be delivered at a given nozzle valve element 16 lift height than was previously possible. Furthermore, the decreased cavitation from improvements in fuel flow reduce cavitation damage to the nozzle valve element 16 and interior surfaces of valve body 12, which includes valve seat 28, fuel flow surface 29 and injector orifice surface 31. Reduced cavitation would permit increased pressure in sac 60 or at injector orifices 42, which may permit a reduced nozzle valve element 16 maximum lift height.

Each injector orifice 42 has a diameter 43 and a cross-sectional flow area Ainj. If N injector orifices 42 exist, the total cross-sectional flow area would therefore be as noted in equation 3.

$$A\text{tot}=(N)(A\text{inj}) \qquad \text{Equation 3}$$

It is preferable that Amax satisfy the relationship noted in equation 4.

$$A\text{max}\geq(3)(A\text{tot}) \qquad \text{Equation 4}$$

Figure 5:
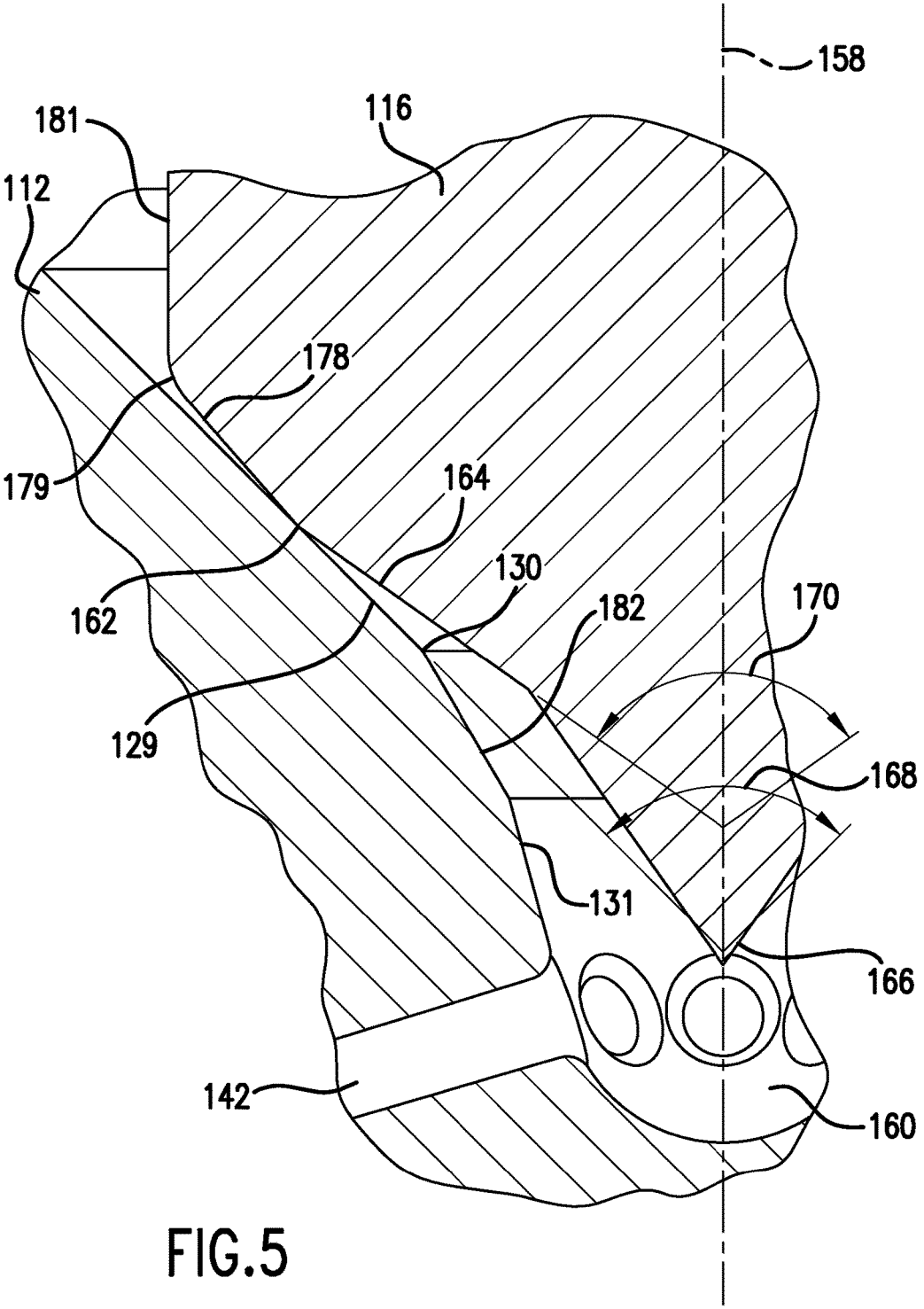
FIG. 5 is a sectional view of a portion of the inward end of a second embodiment fuel injector with the nozzle valve element in the closed position.
Figure 6:
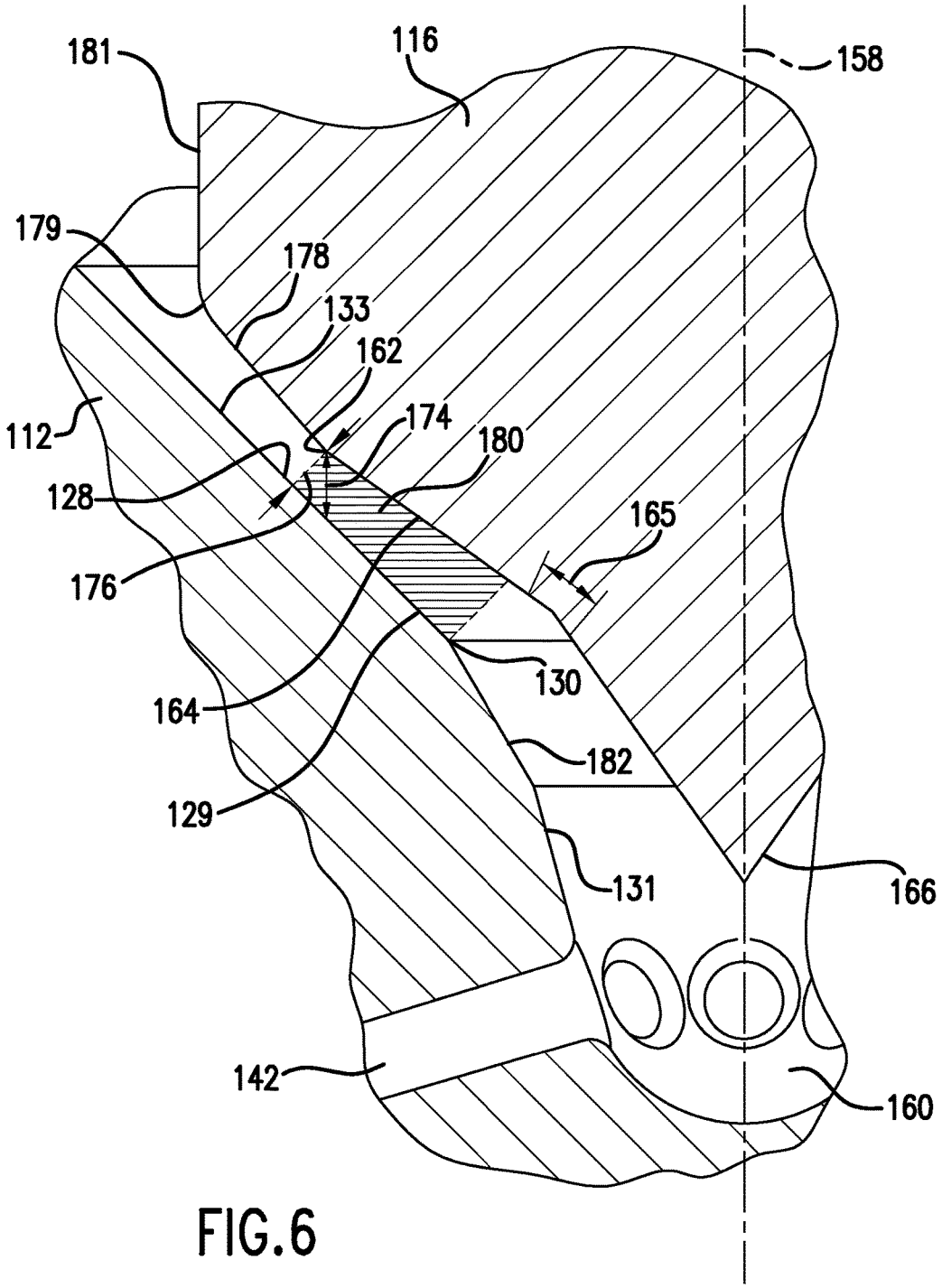
FIG. 6 is a sectional view of a portion of the inward end of the fuel injector of FIG. 5 with the nozzle valve element in the open position.

And second embodiment of the present disclosure is shown in FIGS. 5 and 6. Similar elements in this embodiment to the previously described embodiment are similarly numbered with a "1" added to the number used to describe the previous embodiment. For example, the injector body in the previous embodiment was item number 12. In the second embodiment, the injector body is item number 112, and so forth.

Nozzle valve element, needle valve or plunger 116 includes a contact surface 162. Adjacent contact surface 162 is a first flow-guiding surface 164 that extends toward tip 166 of nozzle valve element 116. First flow-guiding surface 164 terminates at a first curvature or corner 165, which extends to join with nozzle element tip 166. First flow-guiding surface 164 is generally feature-free, as previously described hereinabove, and forms a conical frustum about nozzle valve element 116 that is centered on axis 158 of nozzle valve element 116.

Extending from a valve seat 128 toward an injector sac 160 or an injector orifice 142 is a fuel flow surface 129, which is an extension of valve seat 128 and may be at the same angle as valve seat 128. Fuel flow surface 129 terminates at a second radius or edge 130. Second radius or edge 130 may extend to join with an intermediate surface 182. Intermediate surface 182 then extends to join with an injector orifice surface 131, in which at least one injector orifice 142 is located and which may be part of sac 160.

First flow-guiding surface 164 is formed at a different angle from valve seat 128 and fuel flow surface 129, as shown in FIG. 5. Valve seat 128 and fuel flow surface 129 has a seat angle 168 centered on longitudinal axis 158. First flow-guiding surface 164 is formed at a first flow-guiding surface angle 170 that is greater than seat angle 168. In this embodiment, seat angle 168 is about 90 degrees and first flow-guiding surface angle 170 is between 98 and 103 degrees.

As can be seen in FIG. 6, when nozzle valve element 116 is open at its maximum lift distance 174, the shortest distance between contact surface 162 and valve seat 128 is distance 176. The cross-sectional area between contact surface 162 and valve seat 128 at distance 176 is a conical frustum about axis 158 of nozzle valve element 116 and is defined, as in the previous embodiment, as an ideal cross-sectional area Amax. Since first flow-guiding surface 164 angles away from fuel flow surface 129, the area of any conical frustum between two opposing portions of first flow-guiding surface 164 and fuel flow surface 129, defined as Agap, remains approximately constant or gradually increases slightly with distance from contact surface 162 toward tip 166. Since both fuel flow surface 129 and first flow-guiding surface 164 extend a distance in opposition, there are an infinite number of conical frustums with area Agap in a region 180 between fuel flow surface 129 and first flow-guiding surface 164. As in the previous embodiment, each frustum area Agap(n) at any opposing annuli of first flow-guiding surface 164 and fuel flow surface 129 in region 180 in FIG. 6 must satisfy the inequality of equation 1 when nozzle valve element 116 is at its maximum lift distance 174 in order to maximize flow efficiency between first flow-guiding surface 164 and fuel flow surface 129. Efficiency is at a better optimum if the cross-sectional area Agap satisfies the inequality of equation 2.

Note that a second flow-guiding surface 178 extends from contact surface 162 away from tip 166, which is also away from sac 160 and which is also away from injector orifice or orifices 142. Second flow-guiding surface 178 may extend to a third corner, edge or radius 179 that joins with side 181 of nozzle valve element 116. Second flow-guiding surface 178 is preferably at a shallower angle or a smaller angle than the angle of a second fuel flow surface 133 that extends from seat surface 128 in a direction away from tip 166. Regardless of the angle of second flow-guiding surface 178, the area of a conical frustum extending perpendicularly to second fuel flow surface 133 to intersect second flow-guiding surface 178 must be equal to or great than Amax. Furthermore, it is preferable that the area of each similar conical frustum extending from second fuel flow surface 133 to intersect second flow-guiding surface 178 increases as the distance from contact surface 162 increases. It is also preferable that such increase is gradual and without discontinuities to prevent pressure drops forming between second fuel flow surface 133 and second flow-guiding surface 178 and to assist in limiting cavitation that might occur should discontinuities exist. Note from the foregoing discussion that it is preferable that contact surface 162 be the only location of contact between needle valve element 116 and valve seat 128. It should also be clear from the foregoing discussion that the smallest cross-sectional flow area between nozzle valve element 116 and the inner surface of injector body 112 when nozzle valve element is in an open position is the shortest conical frustum possible between contact surface 162 and valve seat 128. The cross-sectional flow area between nozzle valve element 116 and any downstream point, which includes fuel flow surface 129, radius or edge 130, intermediate surface 182, and injector orifice surface 131, remains approximately constant or gradually increases slightly throughout the distance from the point at which the shortest distance 176 is measured to a location just above injector orifice 142. A relationship exists between seat angle 68, maximum lift distance 74, and first flow-guiding surface angle 70. For a seat angle 68 of 60 degrees and a maximum lift distance 74 of 0.150 millimeters, first flow-guiding surface angle 70 is preferably at least 64 degrees and no more than 69 degrees. For a seat angle 68 of 60 degrees and a maximum lift distance 74 of 0.300 millimeters, first flow-guiding surface angle 70 is preferably at least 70 degrees and no more than 75 degrees. For a seat angle 68 of 90 degrees and a maximum lift distance 74 of 0.100 millimeters, first flow-guiding surface angle 70 is preferably at least 98 degrees and no more than 103 degrees. For a seat angle 68 of 90 degrees and a maximum lift distance 74 of 0.200 millimeters, first flow-guiding surface angle 70 is preferably at least 106 degrees and no more than 111 degrees. As can be seen from the foregoing examples, first flow-guiding surface angle 70 must be at least 4 degrees more than seat angle 68 in order to achieve the benefits of the present disclosure. The difference between first flow-guiding surface angle 70 and seat angle 68 also provides a minimum angle of 2 degrees between first flow-guiding surface 64 and valve seat 28.

In a performance comparison between a standard nozzle with 0.500 millimeter maximum lift distance, a seat angle of 60 degrees and downstream surface angle of about 62.2 degrees and a nozzle valve element built in accordance with this disclosure with a seat angle 68 of 60 degrees, a maximum lift distance 74 of 0.300 millimeters, and a first flow-guiding surface angle 70 of about 71.8 degrees, the peak injection rates were unexpectedly comparable. The nozzle valve element built in accordance with this disclosure unexpectedly closed approximately 0.25 seconds faster than the standard nozzle.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A fuel injector device for injecting fuel into a combustion chamber of an internal combustion engine, the fuel injector device comprising:

an elongate injector body having a longitudinal axis, an injector cavity including an injector sac, an injector orifice communicating with the injector sac, an inner annular surface including a seat positioned upstream of the injector sac and a fuel flow surface extending between the injector sac and the seat, and a fuel supply circuit adapted to supply fuel for injection through the injector orifice; and a nozzle valve element positioned within the injector cavity, the nozzle valve element adapted to move along the longitudinal axis between a maximum open nozzle position, in which fuel flows from the fuel supply circuit through the injector orifice into the combustion chamber, and a closed nozzle position wherein a first end of the nozzle valve element contacts the seat and fuel flow through the injector orifice is blocked, the first end of the nozzle valve element including a tip, a contact surface positioned to contact the seat when the nozzle valve element is in the closed nozzle position, and a generally straight first flow-guiding surface extending from the contact surface toward the tip terminating at a first edge and opposing the fuel flow surface, wherein the first flow-guiding surface is free of discontinuities and is spaced away from the fuel flow surface when the nozzle valve element is in the closed nozzle position;

wherein the first flow-guiding surface forms an angle of at least 2 degrees with the fuel flow surface;

wherein, when the nozzle valve element is in the maximum open nozzle position, the contact surface is positioned a spaced distance from the seat to form a gap having a maximum lift cross-sectional flow area Amax defined by a first conical frustum extending across a shortest distance between the seat and the contact surface; and wherein an annular cross-sectional flow area Agap between the fuel flow surface and the first flow-guiding surface has a first value at a first location adjacent the contact surface and a second value at a second location spaced apart from the contact surface, each of the first location and the second location being upstream of the first edge of the first flow-guiding surface, the second value being larger than the first value, the first flow-guiding surface forming a first angle relative to the longitudinal axis and a second flow-guiding surface of the nozzle valve element downstream of the first edge of the first flow-guiding surface forming a second angle relative to the longitudinal axis that is smaller than the first angle; and wherein a third flow-guiding surface of the nozzle valve element upstream of the contact surface forms a third, non-zero angle relative to the longitudinal axis that is smaller than the first angle and extends to a second edge that joins with a side of the nozzle valve element.

2. The fuel injector device of claim 1, wherein there is a plurality of flow areas Agap, and the size of Agap increases as the distance from the contact surface in a direction toward the injector sac increases.

3. The fuel injector device of claim 2, wherein the injector sac includes a surface and the nozzle valve element tip includes a surface, and at every point along the injector sac surface where a conical frustum may be constructed that extends perpendicularly to the injector sac surface to intersect the nozzle valve element tip an area Atip is generated, wherein Atip increases in size as the longitudinal distance to the injector orifice decreases and the longitudinal distance from the contact surface increases.

4. The fuel injector device of claim 1, wherein the first flow-guiding surface extends to a first tip radius.

5. The fuel injector device of claim 1, wherein the fuel flow surface extends to a radius proximate the injector sac.

6. The fuel injector device of claim 1, wherein the third flow-guiding surface extends from the contact surface away from the nozzle valve element tip and the second fuel flow surface extends from the seat away from the injector sac, wherein a conical frustum having an area Asec(n) may be constructed at any point on the second fuel flow surface where the frustum intersects the third flow-guiding surface, and each area Asec(2) is equal to or greater than any area Asec(1) positioned between the location of area Asec (2) and the seat.

7. The fuel injector device of claim 1, wherein Agap satisfies the inequality $(0.975)(Amax) \leq Agap \leq (1.150)(Amax)$.

8. The fuel injector device of claim 1, wherein the contact surface has a full angle of about 60 degrees centered on the longitudinal axis and wherein the first flow-guiding surface has a full angle of at least 64 degrees and no more than 69 degrees centered on the longitudinal axis.

9. The fuel injector device of claim 8, wherein the maximum distance the nozzle valve element moves off the seat is 0.150 millimeters.

10. The fuel injector device of claim 1, wherein the contact surface has a full angle of about 60 degrees centered on the longitudinal axis and wherein the first flow-guiding surface has a full angle of at least 70 degrees and no more than 75 degrees centered on the longitudinal axis.

11. The fuel injector device of claim 10, wherein the maximum distance the nozzle valve element moves off the seat is 0.300 millimeters.

12. The fuel injector device of claim 1, wherein the contact surface has a full angle of about 90 degrees centered on the longitudinal axis and wherein the first flow-guiding surface has a full angle of at least 98 degrees and no more than 103 degrees centered on the longitudinal axis.

13. The fuel injector device of claim 12, wherein the maximum distance the nozzle valve element moves off the seat is 0.100 millimeters.

14. The fuel injector device of claim 1, wherein the contact surface has a full angle of about 90 degrees centered on the longitudinal axis and wherein the first flow-guiding surface has a full angle of at least 106 degrees and no more than 111 degrees centered on the longitudinal axis.

15. The fuel injector device of claim 14, wherein the maximum distance the nozzle valve element moves off the seat is 0.200 millimeters.

* * * * *